United States Patent [19]

Anderson

[11] 4,169,711

[45] Oct. 2, 1979

[54] METHOD FOR FORMING COAL BRIQUETTES

[76] Inventor: Timothy J. Anderson, 142 Rosewood, Fairmont, W. Va. 26554

[21] Appl. No.: 893,640

[22] Filed: Apr. 3, 1978

[51] Int. Cl.[2] ..... C10L 5/12; C10L 5/40

[52] U.S. Cl. ..... 44/26; 44/16 R; 44/10 R

[58] Field of Search ..... 44/10 F, 10 R, 16 C, 44/16 E, 26, 16 R

[56] References Cited

U.S. PATENT DOCUMENTS

| | | | |
|---|---|---|---|
| 190,724 | 5/1877 | Roettgerr | 44/26 |
| 332,497 | 12/1885 | Cory | 44/26 |
| 367,015 | 7/1887 | Wandrey et al. | 44/26 |
| 417,362 | 12/1889 | Morris | 44/26 |
| 1,029,022 | 6/1912 | Mitchell | 44/26 |
| 1,471,645 | 10/1923 | Chance | 44/26 |
| 1,667,304 | 4/1928 | Bowen | 44/16 F |
| 1,668,643 | 5/1928 | Hart | 44/26 |
| 1,913,121 | 6/1933 | Kern | 44/26 |
| 1,995,366 | 3/1935 | Snell | 44/26 |
| 2,665,977 | 1/1954 | Engelhart | 44/26 |

*Primary Examiner*—Carl Dees

*Attorney, Agent, or Firm*—Armstrong, Nikaido, Marmelstein, Kubovcik

[57] ABSTRACT

Method for forming coal briquettes from coal particles in the size range of ¼ to ¾ inch and containing fines in the range of 20–40% by volume. The coal particles and fines are mixed with sodium silicate and/or potassium silicate as a binder and are compacted into briquettes at a pressure of 100–200 psi, and particularly 140 psi. The resulting briquettes, which are particularly adapted for use as a fuel in home fireplaces, will burn without producing excessive smoke which normally results from burning coal. At the same time, the silicate acts to bond the ash produced during burning such that the burned briquette will maintain its integrity even after it has fully burned and may be removed from a fireplace grate in one piece rather than as loose ash. The briquettes are approximately the size of a wood log in order that they may be conveniently deposited in a fireplace grate.

7 Claims, No Drawings

METHOD FOR FORMING COAL BRIQUETTES

BACKGROUND OF THE INVENTION

Coal for use in home fireplaces and the like has gained increasing popularity in recent years. Of course, one drawback of a fuel of this sort is the excessive smoke it produces as it burns.

In the past, coal briquettes have been produced comprising coal dust or fines bonded by various binders, including sodium silicate. Such fines, however, are difficult to compact into briquettes and contain very little entrapped methane because of their high surface area, with the result that the burning qualities of such briquettes are not particularly good; and they are difficult to ignite.

SUMMARY OF THE INVENTION

The present invention resides in the discovery that the burning qualities of a coal log can be markedly improved by forming the log from freshly crushed coal particles having a predominant size in the range of ¼ to ¾ inch. The coal particles are mixed with a binder, preferably sodium silicate, and are then compressed at a pressure of 100–200 psi to form the resulting log.

DETAILED DESCRIPTION OF THE INVENTION

In carrying out the invention, coal in the size range of ¼ to ¾ inch is first obtained by crushing larger coal lumps. Assuming that coal particles in the size range of ¼ to ¾ inch have just been crushed, they will contain relatively large amounts of methane which will burn with a clean flame as the resulting coal log is consumed. It is important, therefore, that the crushed coal particles be formed immediately into briquettes since, otherwise, the entrapped methane will escape into the atmosphere. The coal particles should contain fines in the range of 20–40% by volume for reasons which will be explained hereinafter.

Mixed with the coal particles and fines is an aqueous solution containing 42.7% by weight of sodium silicate wherein the ratio of $SiO_2$ to $Na_2O$ is about 2.88. Above this ratio, the silicate becomes too viscous and will not evenly coat the coal particles. Beneath this ratio, the viscosity is too low and the particles will not adhere after compaction. This sodium solicate solution is then mixed with the coal particles immediately after the crushing, the aqueous solution comprising 2–4% by weight of the total weight of the resulting log, and preferably 3% by weight. The coal particles mixed with sodium silicate are then compressed in a mold, similar to that of a brick press, at a pressure of 100–200 psi and preferably 140 psi. Compression at 140 psi drives off most of the water in the aqueous sodium silicate solution in the form of water vapor such that the log can be easily handled and need not be cured after compaction.

On the other hand, if the compacting pressure is lower than 100 psi, the resulting log will not maintain its integrity and will fall apart. Above 200 psi, the compaction is too great and the burning qualities of the log suffer due primarily to the fact that the methane within the coal cannot be readily released. Additionally, when the pressure is above 200 psi, the resulting log becomes difficult to ignite and does not readily burn. Coal logs of the type described herein can be packaged individually and sold at retail outlets to the consuming public.

As was mentioned above, the coal particles in the size range of ¼ to ¾ inch should contain 20% by volume of fines and no greater than 40%. Below 20%, the resulting briquette or log tends to spall when an attempt is made to remove it from the mold of the compacting press. Above 40%, the briquette will not retain its shape after compaction and an excessive amount of binder, above 3% by weight, is required. These fines, which inherently occur in a coal crushing operation, will depend upon the type of coal being crushed and the crushing equipment employed. Consequently, both the proper type of coal and the proper crushing equipment must be selected to achieve the required volume of fines.

Although the invention has been shown in connection with a certain specific embodiment, it will be readily apparent to those skilled in the art that various changes in method steps can be made to suit requirements without departing from the spirit and scope of the invention. In this respect, part or all of the sodium silicate can be replaced by potassium silicate.

I claim as my invention:

1. A method for forming coal briquettes consisting of the steps of mixing coal particles having a size range of ¼ to ¾ inch, said coal particles containing fines in the range of about 20–40% by volume, with an aqueous solution of a silicate selected from the group consisting of sodium silicate and potassium silicate, the solution of silicate comprising 2–4% by weight of the mixture thus formed, and compressing the mixture at a pressure in the range of 100–200 psi.

2. The method of claim 1 wherein the silicate is sodium silicate.

3. The method of claim 2 wherein said aqueous sodium silicate solution contains about 42.7% by weight sodium silicate.

4. The method of claim 2 wherein the sodium silicate in said solution contains $SiO_2$ and $Na_2O$ in the ratio of 2.88 parts by weight of $SiO_2$ to one part $Na_2O$.

5. The method of claim 1 wherein the mixture is compressed at a pressure of 140 psi.

6. The method of claim 1 wherein said coal particles are crushed immediately prior to compaction.

7. The method of claim 1 wherein said coal particles contain fines in the range of about 20–40% by volume.

* * * * *